US005557963A

United States Patent [19]

Diekhoff

[11] Patent Number: 5,557,963

[45] Date of Patent: Sep. 24, 1996

[54] METHOD AND APPARATUS FOR NECKING A METAL CONTAINER AND RESULTANT CONTAINER

[75] Inventor: Hans H. Diekhoff, Avonmore, Pa.

[73] Assignee: Aluminum Company of America, Pittsburgh, Pa.

[21] Appl. No.: 260,285

[22] Filed: Jun. 14, 1994

Related U.S. Application Data

[62] Division of Ser. No. 922,913, Jul. 19, 1992, Pat. No. 5,355,710.

[51] Int. Cl.[6] ..... B21D 19/10

[52] U.S. Cl. ..... 72/379.4; 72/356

[58] Field of Search ..... 72/356, 379.4; 413/1, 69; 220/669

[56] References Cited

U.S. PATENT DOCUMENTS

| | | | |
|---|---|---|---|
| 3,757,558 | 9/1973 | Heinle | 72/354 |
| 3,995,572 | 12/1976 | Saunders | 72/348 |
| 4,058,998 | 11/1977 | Franek et al. | 72/84 |
| 4,278,711 | 7/1981 | Sullivan | 427/284 |
| 4,280,353 | 7/1981 | Murphy | 72/435 |
| 4,310,110 | 1/1982 | Dexter | 224/246 |
| 4,341,103 | 7/1982 | Escallon et al. | 72/70 |
| 4,392,764 | 7/1983 | Kubis et al. | 413/69 |
| 4,403,493 | 9/1983 | Atkinson | 72/356 |
| 4,435,969 | 3/1984 | Nichols et al. | 72/126 |
| 4,457,158 | 7/1984 | Miller et al. | 72/354 |
| 4,512,172 | 4/1985 | Abbott et al. | 72/68 |
| 4,519,232 | 5/1985 | Traczyk et al. | 72/133 |
| 4,527,412 | 7/1985 | Stoffel et al. | 72/349 |
| 4,563,887 | 1/1986 | Bressan et al. | 72/84 |
| 4,578,007 | 3/1986 | Diekhoff | 413/6 |
| 4,693,108 | 9/1987 | Traczyk et al. | 72/370 |
| 4,732,027 | 3/1988 | Traczyk et al. | 72/133 |
| 4,760,725 | 8/1988 | Halasz | 72/84 |
| 4,774,839 | 10/1988 | Caleffi et al. | 72/254 |
| 4,781,047 | 11/1988 | Boersma et al. | 72/84 |
| 4,870,847 | 10/1989 | Kitt | 72/84 |
| 4,927,043 | 5/1990 | Vanderlaan | 220/67 |
| 5,297,414 | 3/1994 | Sainz | 72/354.6 |

FOREIGN PATENT DOCUMENTS

| | | | |
|---|---|---|---|
| 299731 | 12/1990 | Japan | 413/69 |
| 248729 | 11/1991 | Japan | 413/69 |

*Primary Examiner*—Lowell A. Larson
*Attorney, Agent, or Firm*—Arnold B. Silverman; David W. Brownlee

[57] ABSTRACT

A method for necking an end of a metal container include effecting initial deformation, generally radially inwardly, of an axial portion to establish a necked-in generally convex transition portion and an adjacent portion disposed between the transition portion and the container end which is initially generally cylindrical. Both portions are of reduced diameter with respect to the original can body diameter. Sequentially, through the series of formation steps, the portion to be necked in is further reduced in diameter to produce an outwardly generally convex portion disposed in underlying relationship with respect to an outwardly concave portion. A generally, radially, outwardly directed flange may be established within the end section of the necked-in portion. Apparatus to perform the foregoing forming steps consists of a plurality of die means which are subjected to relative axial movement and contact and reshape the exterior of the container portion that is to be necked in. An additional embodiment has a necked-in portion having a plurality of alternating convex and concaved portions. A further embodiment has a straight angularly, inwardly oriented portion connected to the body by a radius greater than the radius of the connection to the neck. Products produced by these methods and apparatus are disclosed.

17 Claims, 11 Drawing Sheets

METHOD AND APPARATUS FOR NECKING A METAL CONTAINER AND RESULTANT CONTAINER

This is a division of application Ser. No. 07/922,913, filed Jul. 31, 1992, now U.S. Pat. No. 5,355,710 granted Oct. 18, 1994.

BACKGROUND OF THE INVENTION

1. Field of the Invention

This invention relates to a method and apparatus for necking a metal container, such as a beverage container, to establish a unique configuration within the necked-in area and to the resultant container construction.

2. Description of the Prior Art

It has been known with respect to beverage cans to provide an integrally formed bottom, and a generally cylindrical body portion which terminates in an opening to which a separately formed can end may be secured. It has been known in respect of such containers to provide a reduced diameter portion adjacent the end to be opened to permit access to the contents of the container open end. See generally U.S. Pat. Nos. 4,457,158 and 4,781,047. It has also been known to form such necked-in container portions by spinning and to provide flanges at the free ends thereof. See generally U.S. Pat. Nos. 4,058,998, 4,435,969, 4,927,043 and 4,512,172.

It has also been known in connection with such necked-in portions, created by a conventional process, to provide residual annular ribs. See generally U.S. Pat. Nos. 4,403,493 and 4,578,007. Such ribs in the necked-in portion may project radially outwardly beyond the diameter of the remainder of the container body. See U.S. Pat. Nos. 4,870,847 and 4,927,043.

It has also been known to provide multiple necked-in containers which have a plurality of circumferential ribs. See U.S. Pat. Nos. 4,519,232, 4,693,018 and 4,732,027.

Various forms of equipment and dies for effecting necking of portions of cylindrical metal containers such as, for example, aluminum drawn and ironed containers have been disclosed in the patents referred to hereinbefore. See U.S. Pat. Nos. 4,310,110, 4,563,887 and 4,760,725.

U.S. Pat. No. 4,527,412 discloses an aerosol container which has a restricted neck established by multiple forming processes to create a welded container structure having a domed restricted opening.

U.S. Pat. No. 3,757,558 discloses apparatus for necking in tubular members wherein clearance is provided between the outer die and the inner die in order to reduce friction and compressive forces on the container walls and thereby resist scratches, scores and other defects in the result container product.

U.S. Pat. No. 4,774,839 discloses the necking of container walls in a plurality of stages in order to produce a smooth neck configuration which has a straight angularly disposed necked-in portion separating two curved portions.

Despite the foregoing known methods and apparatus there remains a very real and substantial need for an improved method and apparatus for creating necked-in containers such as beverage containers which have adequate strength, are substantially wrinkle free and devoid of annular rings have an aesthetically pleasing appearance.

SUMMARY OF THE INVENTION

The present invention has met the above-described need.

The method of a first embodiment of the present invention involves effecting a first generally radially inward deformation of an axial portion of the container body adjacent to an open end of the container to create an annular transition portion and an overlying generally cylindrical reduced diameter portion. Subsequently, by additional generally radially inward deformation stages the transition portion is axially enlarged to produce an outwardly convex curved configuration. The cylindrical reduced diameter portion is reformed to establish a generally outwardly concave portion which preferably is merged with the convex portion. The curves preferably meet at their point of tangency. An upper end of the reduced diameter generally cylindrical portion may terminate in a generally radially outwardly directed flange. The outwardly convex portion is preferably of a first radius and the overlying annular outwardly concave portion is preferably of a second radius which is smaller than the first radius.

The apparatus of the present invention preferably includes a plurality of dies which initially establish a necked-in portion having a generally outwardly convex annular transition portion and an overlying reduced diameter cylindrical portion which is converted at least in part into a generally outwardly annular concave portion. The reduced diameter cylindrical portion which is disposed close to the free end of the container may be deformed into a generally radially outwardly projecting flange.

In a second embodiment, the method and apparatus produce a necked-in container which in the transition portion has more than two alternating outwardly convex and outwardly concave sections with certain preferred relationships among the radii.

In a third embodiment, a straight angularly oriented section is connected to a reduced diameter cylindrical portion by a neck radius. The straight section is connected to the undeformed body portion by a body radius which is of larger radius than the neck radius. Certain preferred relationships of radii are provided.

These systems produce uniquely configurated necked-in containers of the invention.

It is an object of the present invention to provide a system for creating uniquely configurated necked-in portions on metal containers through progressive deformation.

It is a further object of the present invention to provide such a system which produces a necked-in portion having an annular outwardly convex curved portion which meets an overlying generally outwardly concave portion or a plurality of alternating convex and concave portions.

It is another object of the present invention to provide another embodiment wherein a necked-in portion has a straight section with preferred radii connecting it to adjacent body and neck portions of the container.

It is a further object of the present invention to provide a necked-in container which has improved compressive load characteristics.

It is a further object of this invention to provide such a system which establishes necked-in portions which are substantially devoid of annular rings and undesired wrinkles.

It is yet another object of the present invention to provide such a system which may be employed with relatively thin aluminum drawn and ironed beverage cans.

It is another object of the present invention to provide a die-forming system which will provide a necked-in container having both desired functional properties and aesthetic appearance.

It is another object of the present invention to provide such a system which may be employed on standard equipment provided with custom designed dies.

These and other objects of the present invention will be fully understood from the following description of the invention with reference to the drawings appended hereto.

DESCRIPTION OF THE PREFERRED EMBODIMENTS

Figure 1:
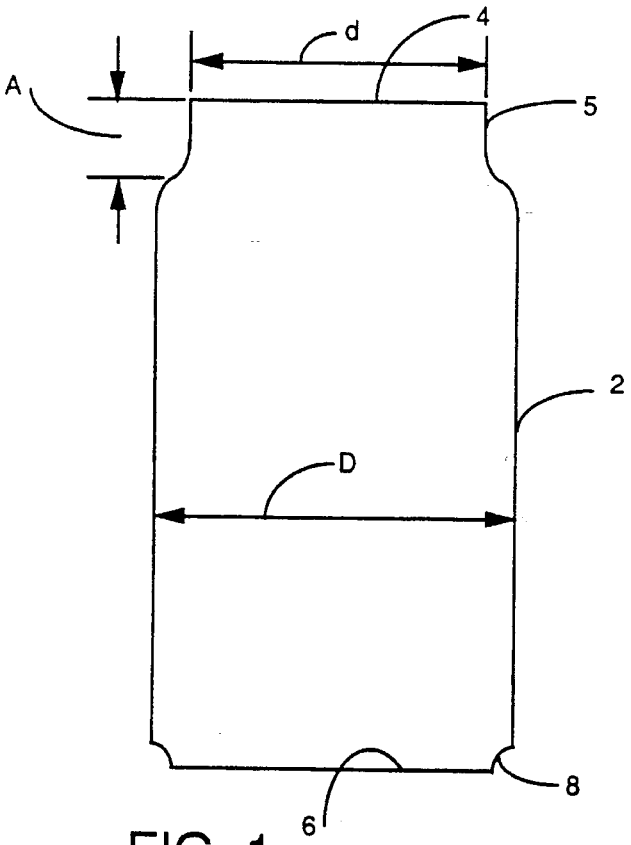
FIG. 1 is an elevational view of a container formed by the system of the present invention.

Referring once again to FIG. 1, there is shown a container having a generally cylindrical body 2 and upper end 4 having a necked-in portion 5 of reduced diameter and an integrally formed bottom wall 6 adjacent in which is a reduced diameter portion 8. The container may be an aluminum drawn and ironed container adapted for use with beverages and having a suitable flange (not shown in this view) for securement of an end to the container. After filling the container a separately created can end will be secured to the necked-in portion 5. The cylindrical container body 2 has a diameter D and the necked-in portion 5 has a lesser diameter d. The necked-in portion 5 is disposed adjacent to the open end 4 and has an axially extent A.

Figure 2:
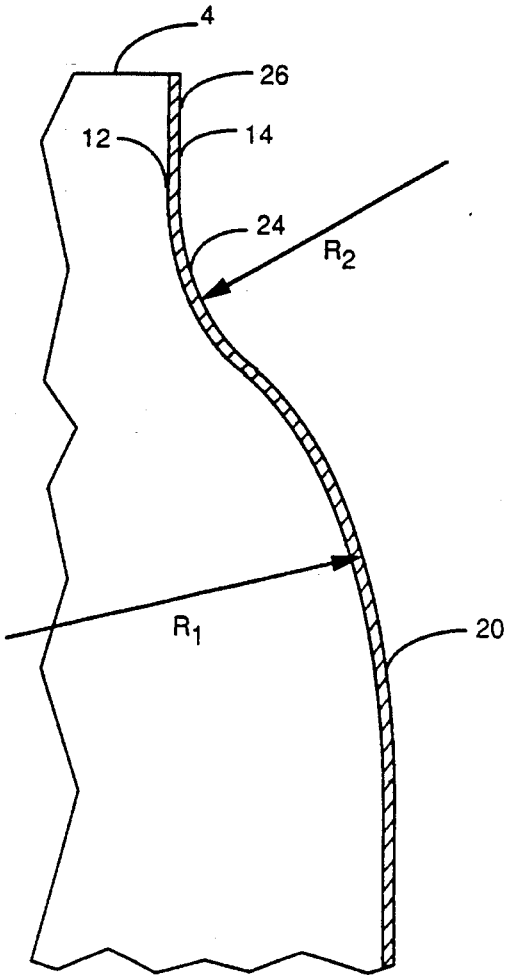
FIG. 2 is a fragmentary cross-sectional illustration of a necked-in portion of a container formed by the present invention.

Referring to FIG. 2, a cross-sectional detail of of the necked-in sector 5 is illustrated. The necked-in sector 5 has an inner surface 12 facing the interior of the container and an outer surface 14 facing the exterior of the container. Through a series of progressive forming stages which will be described hereinafter, the necked-in portion will be established with a diameter throughout that is less than diameter D of the cylindrical body of the container. It will also preferably be substantially devoid of deformations in the form of annular rings, wrinkles and other undesired deformations.

The annular lower portion 20 of the necked-in portion 5 is generally outwardly convex and has a radius $R_1$. The annular upper portion 24 of the necked-in portion is generally outwardly concave and has a radius $R_2$. In the preferred practice of this invention the two sections 20, 24 will merge into each other at a point tangent to the two curves. It will be appreciated that the contour consists of the two curved portions 20, 24 merging into each other. In a preferred practice of the invention, the upper portion 26 of the sidewall adjacent to the opening 4 will be maintained substantially cylindrical in order to permit it to be reformed to provide a generally radially outwardly projecting flange to facilitate securement of a can end to the container.

In the form illustrated in FIG. 2, the first radius $R_1$ will be larger than the radius $R_2$. For example, radius $R_1$ may be 0.500 inch and the radius $R_2$ may be about 0.250 inch. The axial height of the transition portion which includes curved sections 20, 24 may be 0.533 inch. In general, it will be preferred to have this height be a minimum of 0.500 inch. This relationship provides a smoothly contoured necked-in portion while having desired axial compressive loading characteristics.

Figure 3:
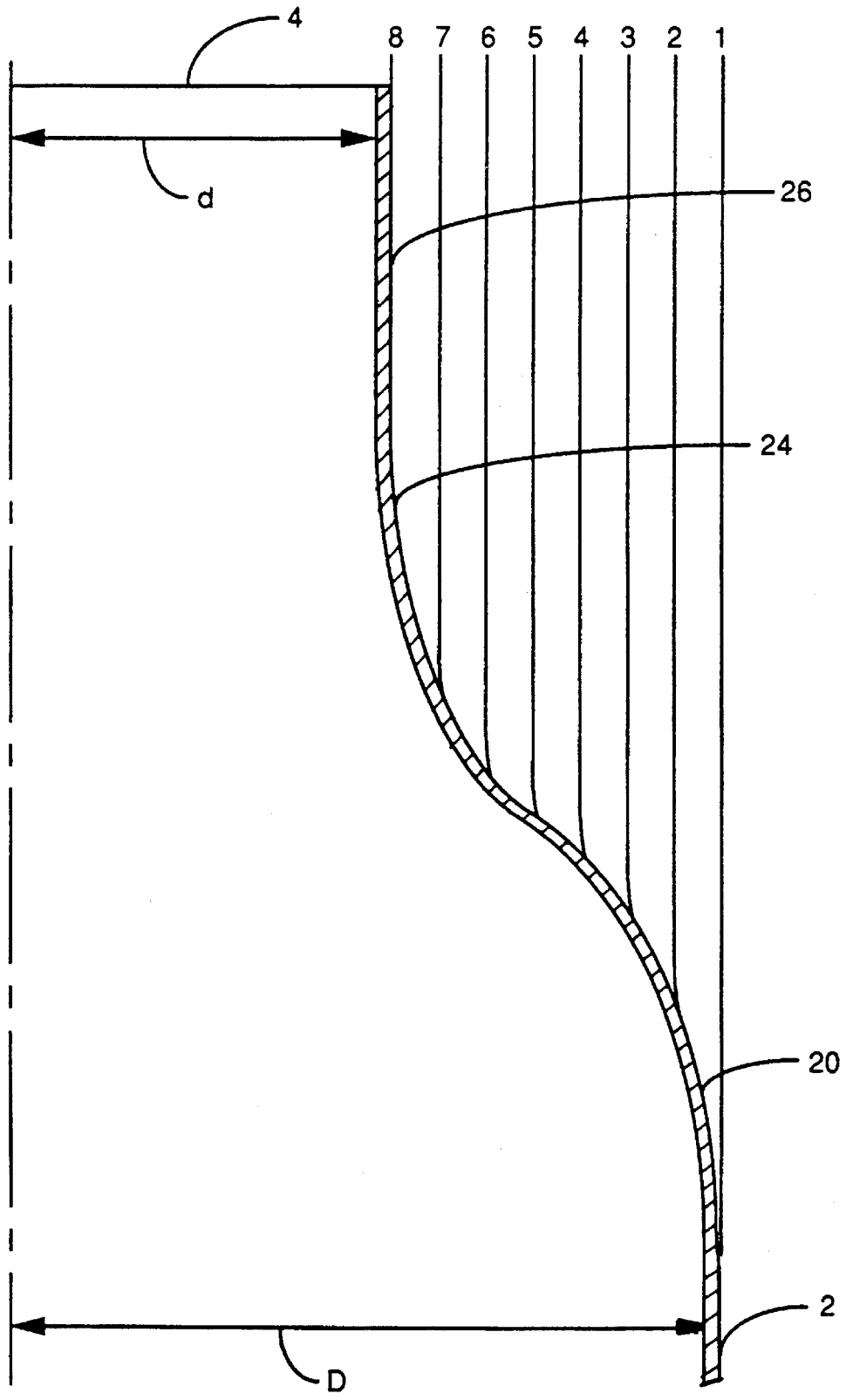
FIG. 3 is a schematic illustration of a sequence of forming of a profile of the first embodiment of this invention.

Referring to FIG. 3, there is shown a sequence of a preferred eight stage forming process employing different radii than in FIG. 2. The numbers at the top of FIG. 3 identify she successive stages with the eighth stage being the final stage. The open end of the container 4 is shown at the top and the undeformed can body 2 of diameter D at the bottom of this figure. All sections of the necked-in portion will have a diameter less than diameter D of body 2. At the end of the first stage of forming the portion to become necked-in portion 5 has the configuration underlying the line numbered 1. It will be appreciated that the outwardly convex portion 20 has a very limited axial extent with the remainder of the necked-in portion being a reduced diameter generally cylindrical portion. Through successive forming stages the axial extent of the outwardly convex portion 20 will be increased and the outwardly concave portion 24 will begin to be formed. The uppermost portion 26 will maintain its generally cylindrical configuration and be successively reduced in diameter.

By way of specific example, the axial length of outwardly convex portion 20 at the initial forming stage may be 0.5171 inch and through successive stages at the end of the eighth forming step may have an axial length of 1.0953 inch. It will also be appreciated that the reduction in diameter of the generally cylindrical portion 26 between the first step and the eighth step will preferably be affected in generally equal reductions. For example, the range of reduction of diameter with each step may be on the order of about 0.038 to 0.042 inch.

With regard to the apparatus of the present invention it will be appreciated that one of the advantages of the invention is that the container handling and forming apparatus may be that conventionally employed in the industry, subject to providing the unique die set configuration for each sequence of reforming of the present invention. Forming is effected by dies without requiring spinning.

Figure 4:
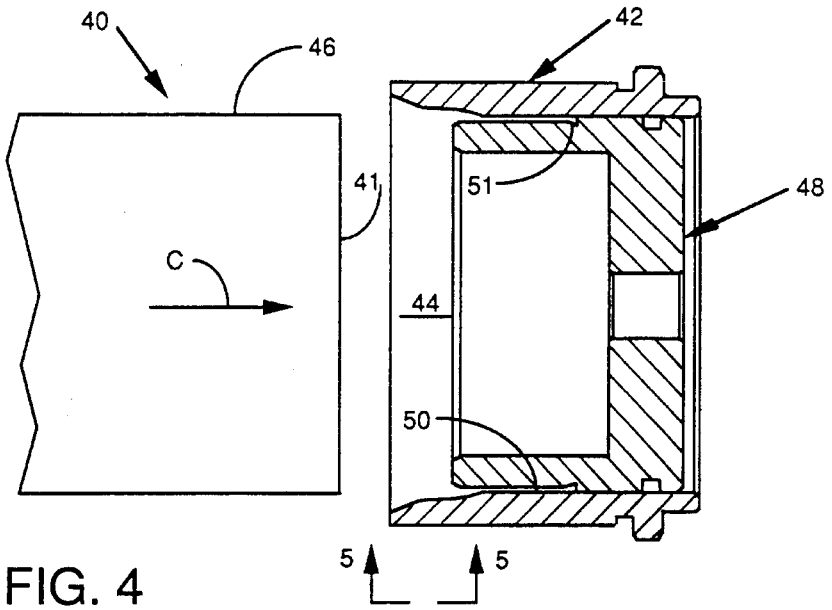
FIG. 4 is a cross-sectional illustration of a form of die employable in the first reduction stage of the first embodiment of the present invention.
Figure 5:
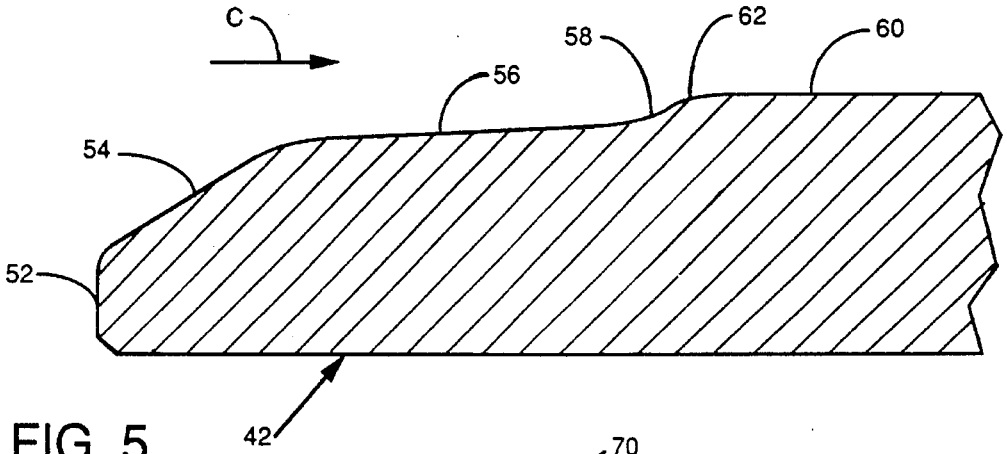
FIG. 5 is a fragmentary cross-sectional illustration of a portion of the die of FIG. 4 taken through 5—5 thereof.

Referring to FIGS. 4 and 5, the die configuration employed to create the first stage of reduction illustrated in FIG. 3 will be considered. The container 40 which has an opening 41 will be introduced into die 42. The die 42 has die cavity 44 within which is a knock-out 48. Relative closing movement is established between the container 40 and die 42 as by moving the container in the direction indicted by arrow C. Portion 46 of the container 40 will be circumferentially necked-in under the influence of a portion of interior surface 50 of die 42. A knock-out 48 which may be reciprocated by conventional means to move the container 40 out of the die 42 after forming has an annular step 51 which engages the front of container 40. The annular gap defined between the outer surface of knock-out 48 and the inner surface of die 42 receives the leading portion of container 40 and serves to resist wrinkling thereof.

Referring to FIG. 5, which shows a detail of the die portion 50 (FIG. 4), it will be noted that starting at the free end 52 there is an inner pilot surface 54 which will contact the leading edge of the container 40 which has an undesired ovality and urges it generally radially inwardly with a cylindrical container which does have undesired ovality the leading edge at opening 41 will initially contact die surface 56 which is of restricted diameter. Further movement causes the formation of outwardly convex transition portion on die surface 58 with the leading edge of the portion to be necked coming into contact with inner die surface 60. The net result of formation by this die will be the creation of the first stage of outwardly concave surface 20 (FIG. 2) by die surface 58 and the first stage of reduced diameter portion 26 (FIG. 2) by die surface 60. A relatively small reversely curved section of the die 62 will begin to establish outwardly concave necked-in portion 4.

Surface 58 may have a radius of 0.190 inch. Surface 62 may have a radius of 0.070 inch and the combined axial extent of surfaces 58 and 62 may be 0.1171 inch. Surface 60 may have a diameter of 2.5500 inches.

Figure 6:
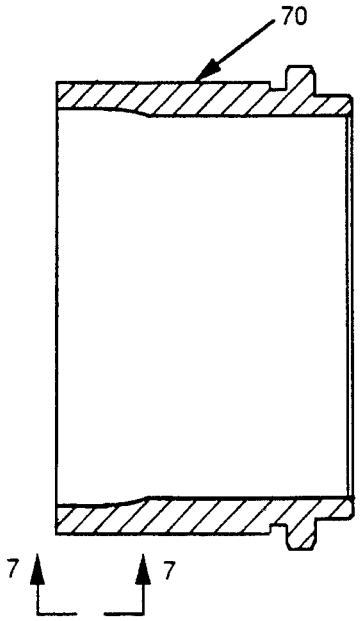
FIG. 6 is a cross-sectional illustration of a die usable in the second reduction stage of the present invention.
Figure 7:
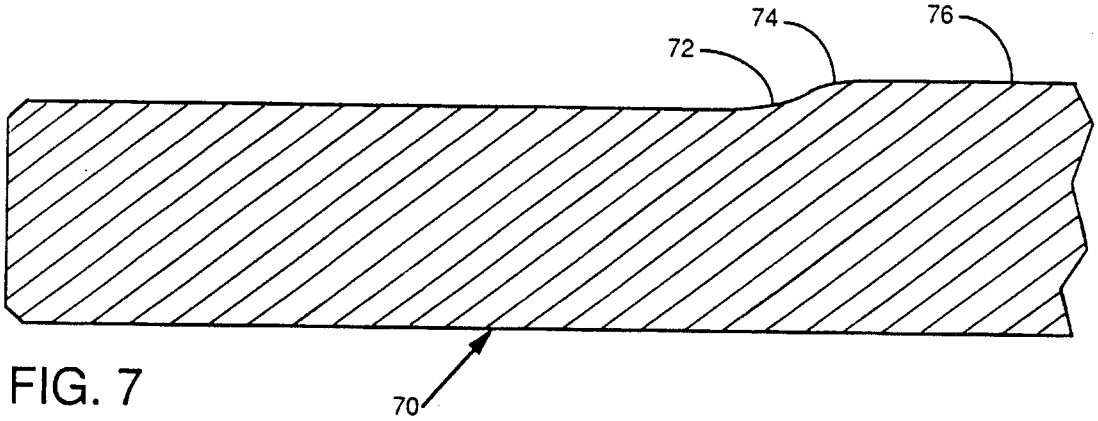
FIG. 7 is a cross-sectional illustration of a portion of the die shown in FIG. 6 taken through 7—7.

Referring to FIGS. 6 and 7, die 70 has interior surface employed in the second forming stage. Die 70 and the other dies employed will also have a knock-out (not shown) to remove the container from the die after forming. In this second stage of formation, the outwardly convex transition sector will be formed by curved portion 72 which has a larger radius than corresponding portion 58 of die 42. The concave portion will be formed by surface 74 which has a greater radius than portion 62 of die 42. Interior cylindrical surface 76 has a smaller internal diameter than the corresponding diameter of surface 60. Also, the combined axial extent of the curved portions is greater than that of the corresponding curved portions of FIGS. 4 and 5. The radius 62 may be 0.070 inch and the two curves combining in FIG. 5 may have an axial extent of 0.1171 inch. The interior diameter of surface 60 may be 2.5500 inches. In FIG. 7, the radius 72 may be 0.210 inch with the radius 74 being 0.200 inch and the axial extent of the two curves being 0.1941 inch. The interior diameter of surface 76 may be 2.5080 inches. The axial extent of the convex portions also increases with successive steps.

Figure 8:
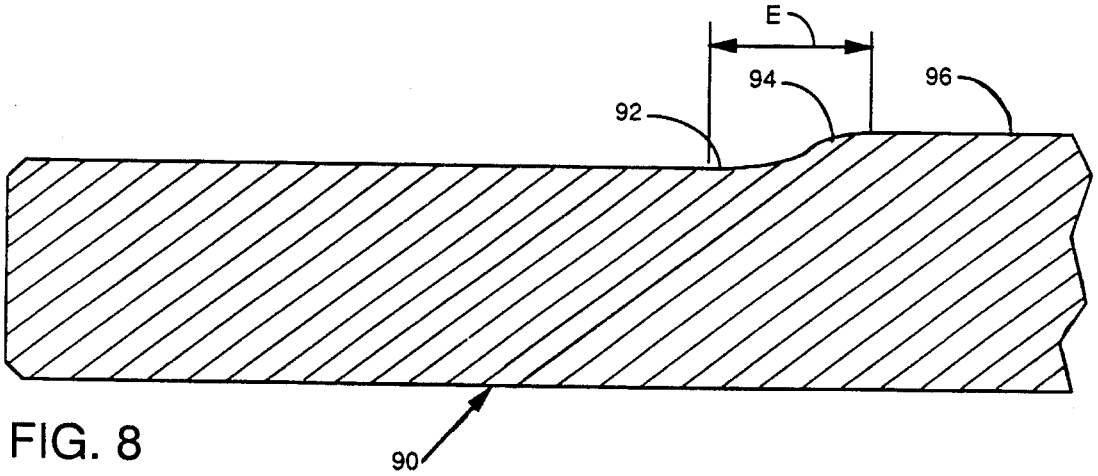
FIGS. 8 through 13 are cross-sectional illustrating generally similar to FIG. 7 but show, respectively, reduction stages 3 through 8.

Referring to the third stage of forming as shown in FIG. 8, die 90 has a surface 92 for establishing the convex transitional portion, a surface 94 for establishing the concave portion and a cylindrical surface 96. In this embodiment, the axial extent of the two curved portions indicated by the letter E has been increased. In this embodiment, the radius of portion 92 may be 0.260 inch, for example. The radius of portion 94 may be 0.200 inch and the interior diameter of surface 96 may be 2.4670 inches. It will be appreciated that the axial extent E of the combined curves 92, 94 and the radius of surface 92 have been increased and the interior diameter of the die at 96 is reduced in successive stages. Similar changes occur in the subsequent dies.

Figure 9:
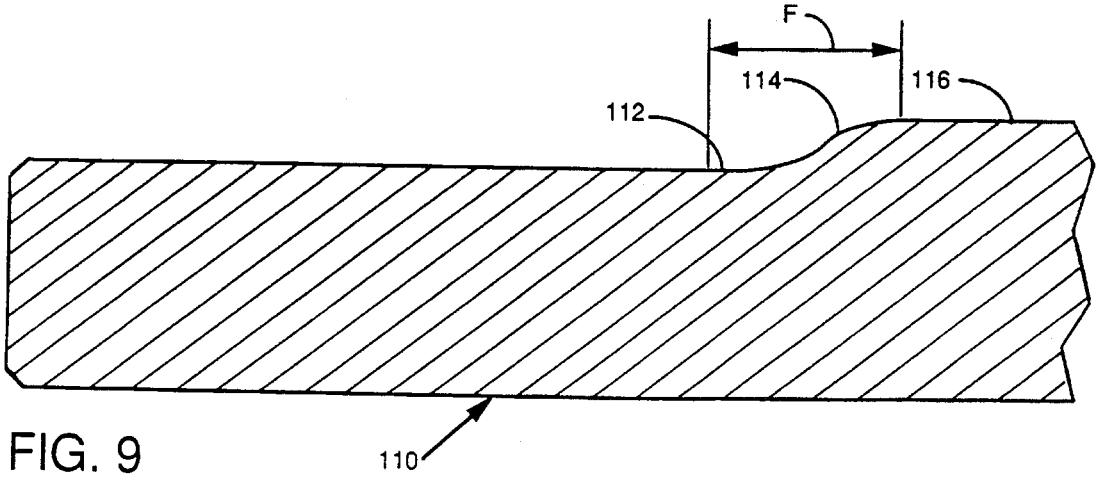

In the fourth stage shown in FIG. 9, die 110 has a surface 112 to create the annular convex surface on the necked-in-portion and surface 114 to create the concave portion and the cylindrical portion 116. The axial extent F of the two curved portions 112 and 114 exceeds axial extent E of die 90 of FIG. 8. The radius of 112 may be 0.300 inch, the radius of 114 may be 0.180 inch and the axial extent 0.2798 inch. The diameter of surface 116 may be 2.4260 inches.

Figure 10:
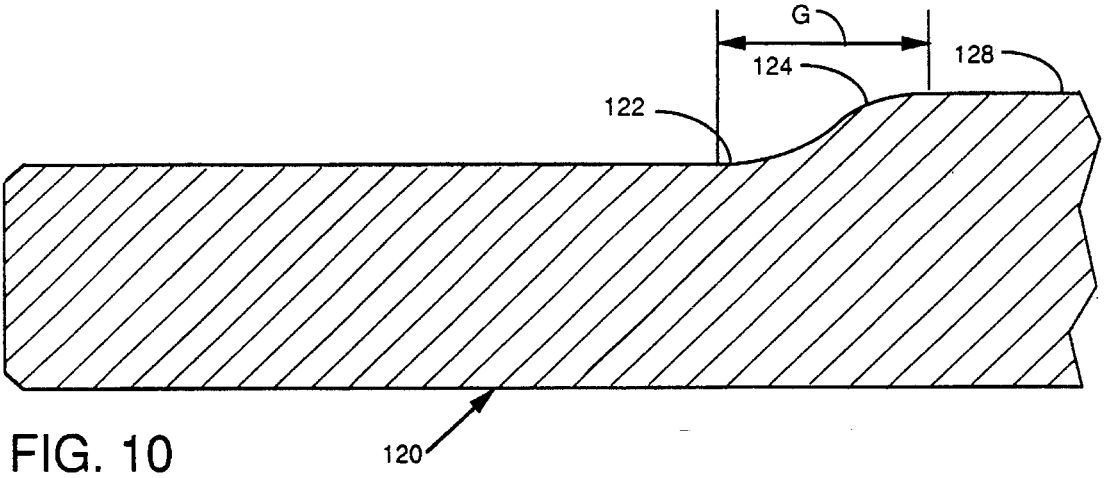

Referring to FIG. 10, the fifth reduction die 120 has a surface 122 for forming the convex portion, a surface 124 for forming the concave portion and a cylindrical portion 128. The axial extent G is greater than the axial extent F of the next proceeding stage, shown in FIG. 9. In this embodiment, the radius of surface 122 may be 0.300 inch, the radius of surface 124 may be 0.200 inch and the axial extent of the combined surfaces 0.3129 inch. The interior diameter at surface 128 may be 2.3860 inches.

Figure 11:
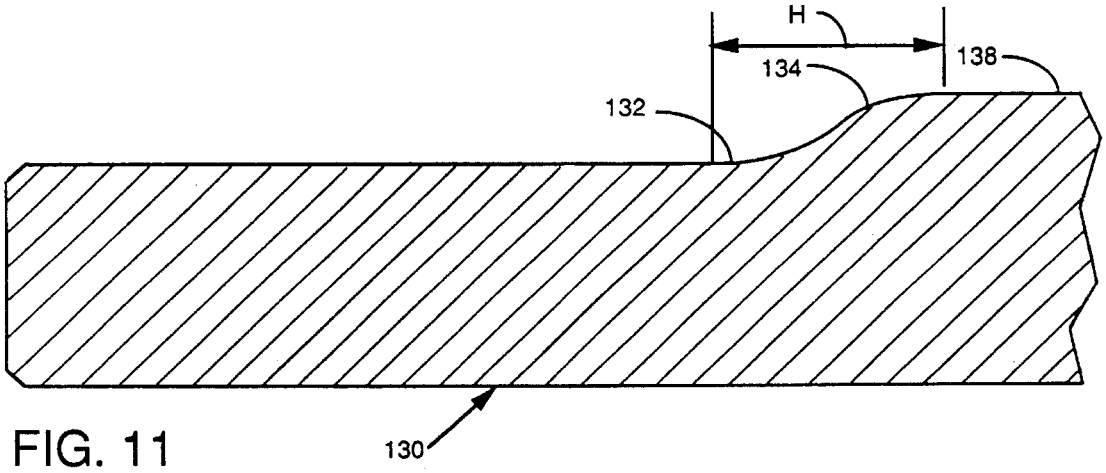

In the sixth forming stage shown in FIG. 11, die 130 has surfaces 132, 134 for forming respectively the convex and concave surfaces. Reduced cylindrical die surface 138 is provided. Axial extent H is larger than axial extent G of FIG. 10. Surface 132 may have a radius of 0.300 inch, surface 134 may have a radius 0.220 inch and the combined axial extent H may be 0.3434 inch with the internal diameter of surface 138 being 2.3470 inches.

Figure 12:
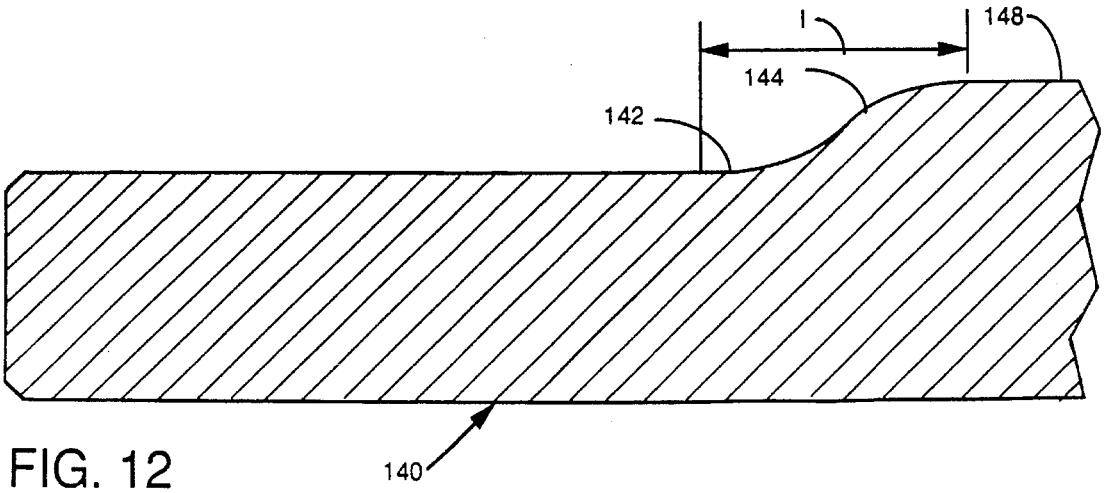

In FIG. 12, the die 140 has surface 142, a surface 144, vent passage 146, cylindrical portion 148 and combined axial extent I. The radius of surface 142 may be 0.300 inch. The radius of surface 144 may be 0.240 inch. The axial extent I is greater than axial extent H may be 0.3724 inch and the internal diameter 148 may be 2.3080 inches.

Figure 13:
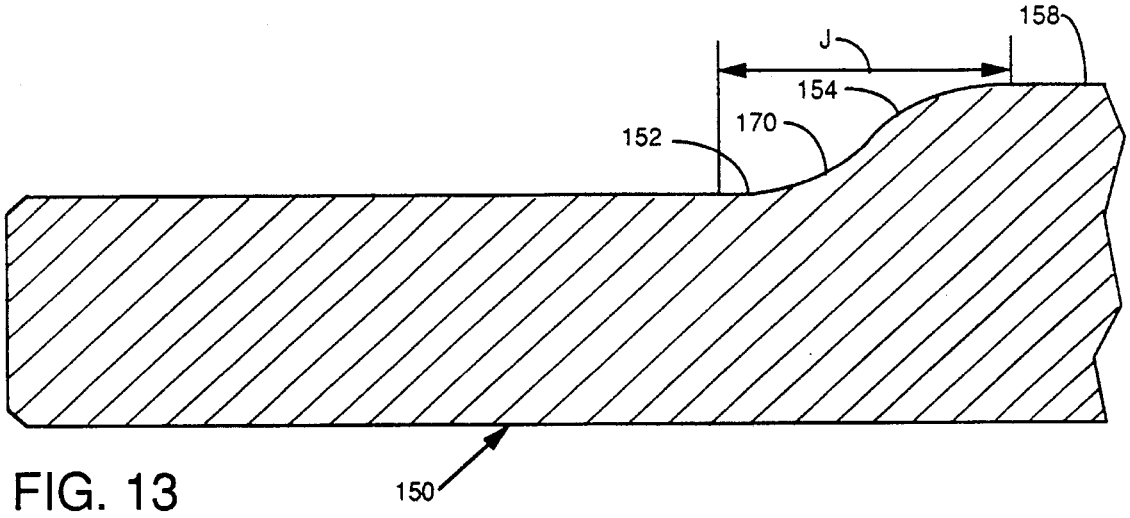

Finally, referring to FIG. 13, die 150 has curved surface 152, curved surface 154 and internal surface 158. The axial extent of the combined curved surfaces is J. It is in this stage that the final configuration of necked-in container will be established. The curved surface 152 may have a radius 0.300 inch, the curved surface 154 may have a radius 0.250 inch and internal diameter of surface 158 may be 2.2700 inches. Axial extent J is larger than axial extent I and may be 0.3956 inch.

It is preferred that each reduction step effects generally an equal amount of radial reduction. The axial extent of the convex portion preferably increases between the first and last deformation steps in the amount of about 1.5 to 2.5 times its original dimension.

The invention may be used, for example, on a cylindrical aluminum can formed by drawing and ironing, a body stock intended for drawing and ironing such as 3004-H19, for example, having a container wall thickness in the portion which is not necked of about 0.0040 to 0.0050 inch, an axial length measured internally of about 4 13/16 inches (413) and an internal diameter in the undeformed cylindrical portion of about 2.603 to 2.605 inches. The necked-in portion may have a wall thickness of about 0.00060 to 0.00065 inch. The internal diameter of the neck opening may be about 2.160 inches. A container end which may contain an integral opening device may be secured to this container by conventional means.

It will be appreciated, therefore, that by the method of this invention employing the apparatus described, the use of the preferred eight stages of formation produces a desired necked-in configuration wherein the two curved surfaces 152, 154 will meet at 170 (FIG. 13). The necked-in curved container surfaces will merge into each other without any intervening surfaces. The annular line 170 is preferably where the tangents to the two surfaces meet.

Figure 14:
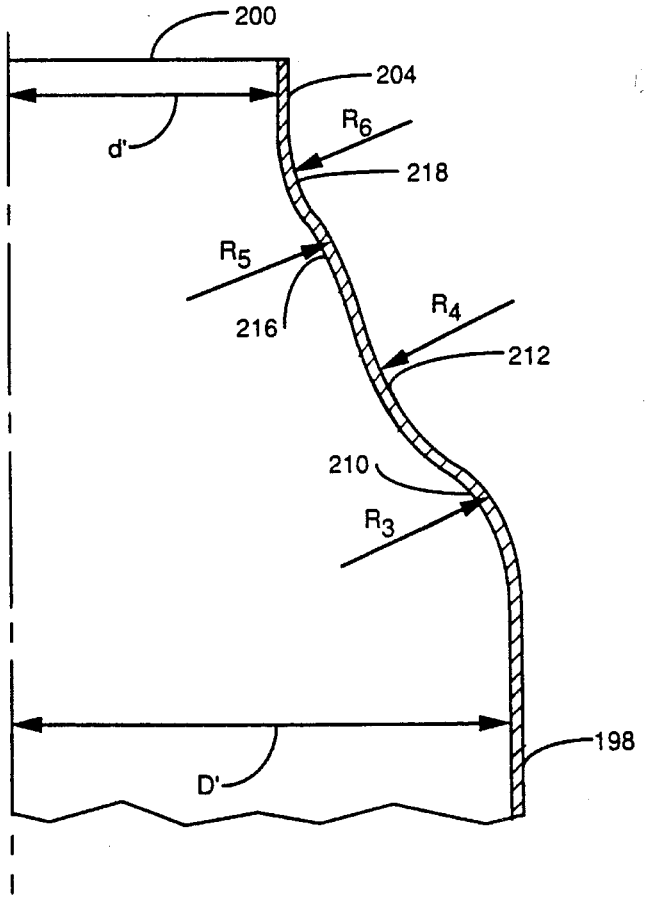
FIG. 14 is a cross-sectional illustration of a necked-in section of a modified form of the invention.

Referring more specifically to FIG. 14, which shows a cross-section of a necked-in portion of a second embodiment of the invention, the metal container has a body 198 with a diameter D' and terminates in an open end 200 which has a diameter d'. Adjacent the open end 200 is a generally cylindrical portion 204, a portion of which may be flanged outwardly to create a generally radially outwardly projecting annular flange (not shown) which will facilitate securement of a can end thereto. Whereas, the first embodiment of the invention contemplated the use of a pair of curved sections having a outwardly convex curve adjacent to the cylindrical body wall and an overlying outwardly concave portion between the necked-in cylindrical portion and the outwardly convex portion, the present embodiment contemplates providing at least three such alternating convex-concave curved portions. FIG. 14 shows an embodiment with four curves. Adjacent and merging into cylindrical body wall 198 is outwardly convex wall section 210 which has a radius $R_3$. Immediately overlying and merging into annular wall section 210 is annular wall section 212 which is outwardly concave and has a radius $R_4$. Overlying and merging into outwardly concave annular portion 212 is outwardly convex annular portion 216 which has a radius $R_5$. Interposed between annular wall section 216 and cylindrical necked-in portion 204 is outwardly concave wall section 218 which has radius $R_6$.

In a preferred version of this second embodiment of the invention, radius $R_4$ will be greater than each of radius $R_3$, $R_5$, and $R_6$. Radius $R_3$ and $R_5$ will each be greater than radius $R_6$. For example, $R_3$ may equal 0.300 inch, $R_4$ may equal 0.400 inch, $R_5$ may equal 0.300 inch, and $R_6$ may equal 0.175 inch. As is true with other embodiments, the entire transition portion 210, 212, 216, 218 preferably has an inside diameter less the body diameter D'.

By way of further example, the overall axial height of the portion containing the four curves 210, 212, 216, 218 may be about 0.493 inches.

It is generally desirable to provide a container which in an empty state will be able to sustain a compressive load of at least about 250 lbs. in an axial direction without undesired deformation of the container.

Figure 15:
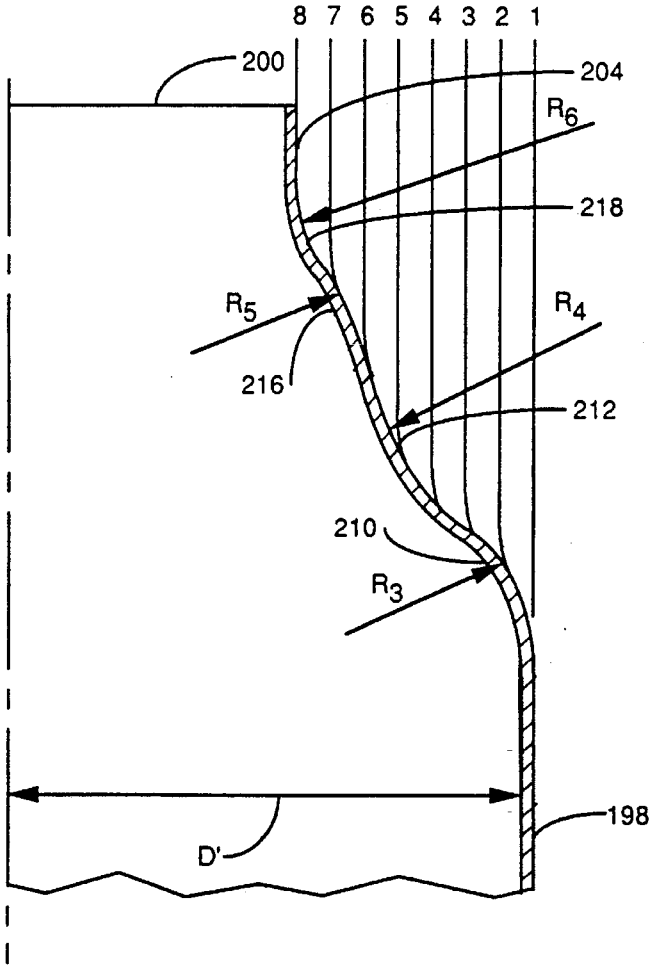
FIG. 15 is a schematic illustration of a sequence of forming of the embodiment shown in FIG. 14.

FIG. 15 shows a sequential illustration of the second embodiment of this invention with slightly different radii valves $R_3$, $R_4$, $R_5$ and $R_6$ than shown in FIG. 14. The numbers at the top each relate to the neck container in the eight forming stages with step 8 being the final profile.

Figure 16:
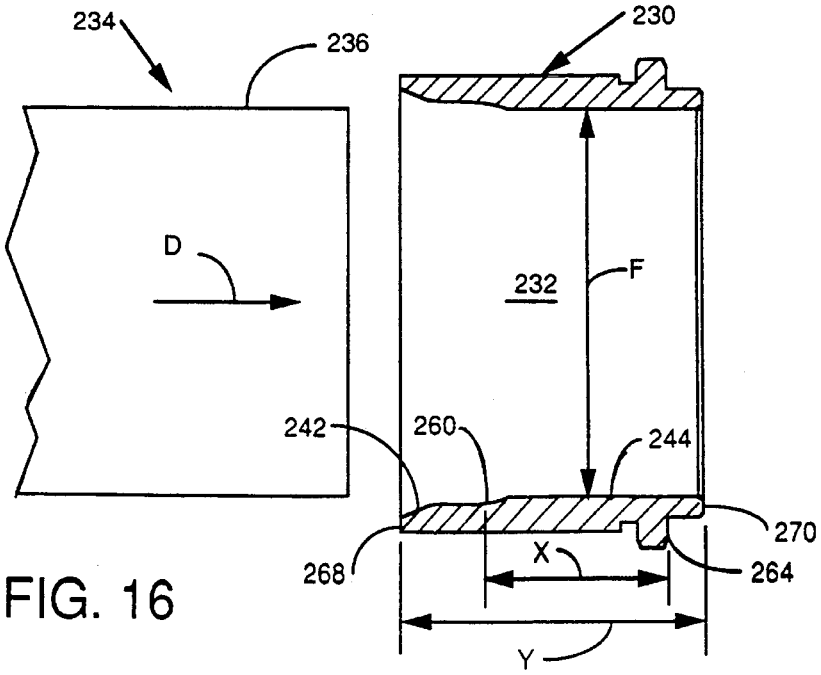
FIG. 16 is a cross-sectional illustration of a form of die employable in the first reduction stage of the second embodiment of the present invention.
Figure 17:
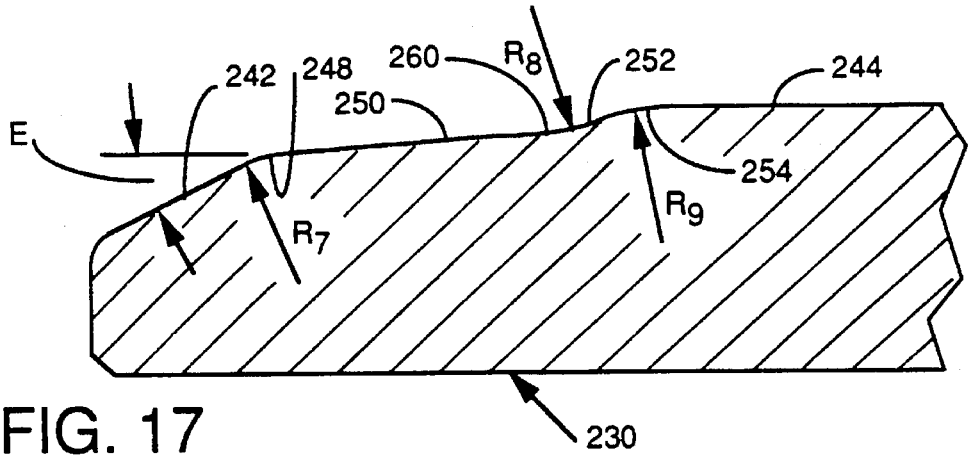
FIG. 17 is a fragmentary cross-sectional illustration of a portion of the die of FIG. 16.

A presently preferred means of establishing the end profile of the four curve form as exemplified by FIGS. 14 and 15 involves a multi-stage forming process similar to that employed with the first embodiment, but with modified tools. Referring to FIGS. 16 and 17, a die 230 (knock-out not shown) has an opening 232 which will receive a metal container 234 which has a generally cylindrical circumferential wall 236 and will be moved axially in the direction indicated by arrow D and enter the die recess 232. The annular die 230 has a pilot surface 242 which tapers generally inwardly. A generally cylindrical interior surface 244 is provided. Disposed between pilot surface 242 and cylindrical surface 244 are a convex die portion 248, an angular straight body die pilot portion 250, a concave die portion 252 and a convex die portion 254. In one form of this embodiment, the angle E of the pilot surface will be about 30 degrees and the radius $R_7$ will about 0.150 inch. Interior diameter F of surface 244 will be 2.54 inches. The angle F of straight section 250 will be about 3 degrees and the axial extent of section 250 will be 0.1813 inches. Radius $R_8$ of section 252 will about 0.330 inch and radius $R_9$ of section 254 will be about 0.15 inch. The axial extent of zones 252 and 254 total 0.1510 inch and the total axial distance X between 260 and 264 is 1.400 inch. The axial distance Y from the front surface 268 of the tool to the rear surface 270 Y is 2.060 inch.

Figure 18:
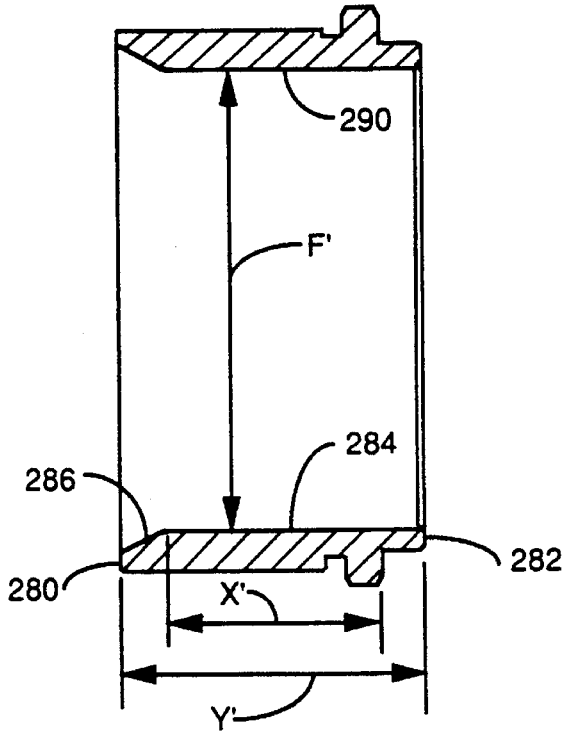
FIG. 18 is a cross-sectional view of a die usable in the second forming operations of the second embodiment of the invention.
Figure 19:
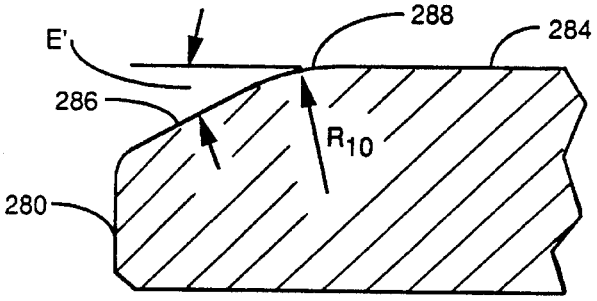
FIG. 19 is a cross-sectional illustration of a portion of the die of FIG. 17.

Referring to FIGS. 18 and 19 a die employable in the second reduction stage of this embodiment of the present invention will be considered. This die has an annular front surface 280, a rear shoulder 282 and inner cylindrical surface 284, an angularly disposed pilot surface 286 and a curved transition section 288 which connects cylindrical section 284 with pilot surface 286. In this embodiment, the axial distance X' is 1.444 and the axial distance Y' is 1.645. The radius $R_{10}$ of section 288 is 0.230 inch and the angle E' is 27 degrees. If desired, cylindrical surface 284 may be provided as angular straight body die portion.

The dies employed for the third through sixth stages which produce a four curve profile of the general type shown in FIG. 14, will have a generally similar configuration to those illustrated in FIGS. 18 and 19, but will have different dimensions.

In the preferred third reducing die, distance X' will be 1.108 and distance Y' will be 1.645 inch. Angle E' will be 28.5 degrees and the radius in the position of $R_{10}$ will be 0.230 inch.

Interior diameter F' of inner cylindrical surface 290 will be 2.490 inch.

For the fourth reduction stage, axial extent X will be 1.065 inch and axial extent Y will be 1.645 inch with internal diameter F being 2.3920 inch. Angle E will be 30 degrees and radius in the position of $R_{10}$ will be 0.230.

In the fifth reduction, the axial extent X will be 1.023 and axial extent Y will be 1.645 inch with internal diameter F being 2.3440 inch. Radius $R_{10}$ will be 0.230 and angle E will be 31.5 degrees. In the final reduction stage, axial extent X will be 0.982 inch and axial extent Y will be 1.645 inch with internal diameter F being 2.2720. Radius $R_{10}$ will be 0.230 inch and angle E will be 33 degrees.

Figure 20:
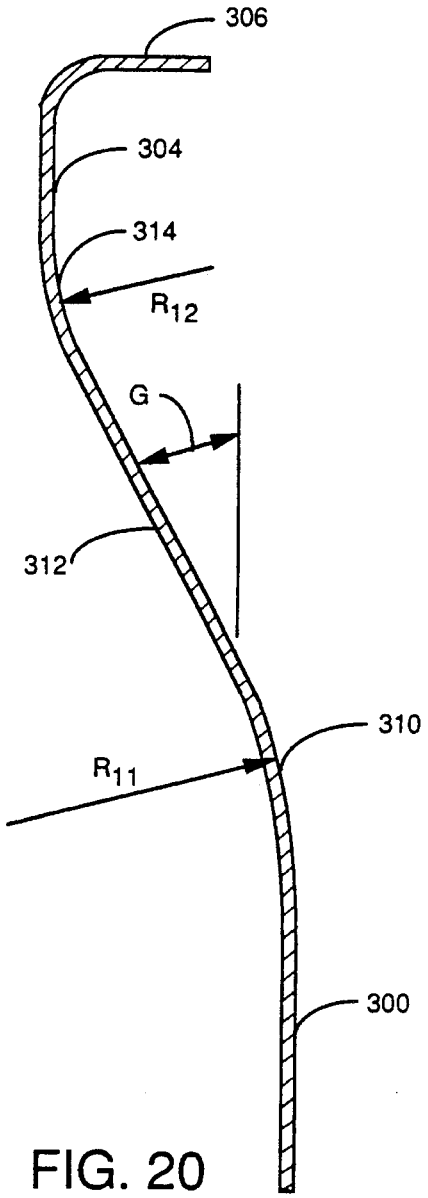
FIG. 20 is a profile of a third embodiment of the invention.

Referring to FIG. 20, a third embodiment of the invention will be considered. In this embodiment, a metal can has a cylindrical body 300, upper cylindrical portion 304 having an end 306 which is flanged generally radially outwardly. Interposed between cylindrical body portion 300 and cylindrical necked-in portion 304 is a transition portion which has a lower outwardly convex portion 310 having a radius $R_{11}$ underlying generally straight angularly disposed portion 312 and cylindrical portion 304 which assumes an angle G with respect to the vertical. Interposed between the uppermost extremity of straight section 312 is an outwardly concave portion 314 which has a radius $R_{12}$.

In the preferred practice of this embodiment of the invention, the neck radius $R_{12}$ will be less than the body radius $R_{11}$ the preferred range of difference being about 0.075 to 0.125 inch. Remaining within this relationship between the two radii $R_{12}$, $R_{11}$ produces increased axial compressive load capability of the can. The body radius $R_{11}$ preferably is within the range of about 0.275 to 0.350 inch and the neck radius $R_{12}$ is preferably within the range of about 0.150 to 0.250 inch which produces a range of angles G of about 28 to 38 degrees. The preferred angle G is about 30 to 36 degrees.

The transition portion preferably has an axial height of at least about 0.500 inch.

It has also been found that within these parameters metal in the necked-in section of 0.0065 gauge has superior column load capability to metal of 0.0060 inch with the other parameters being equal. In addition, an increase in neck height measured from the lowest portion of section 310 to the upper portion of section 314 from about 0.450 to about 0.550 inch results in an increase in column load capability of the container.

Figure 21:
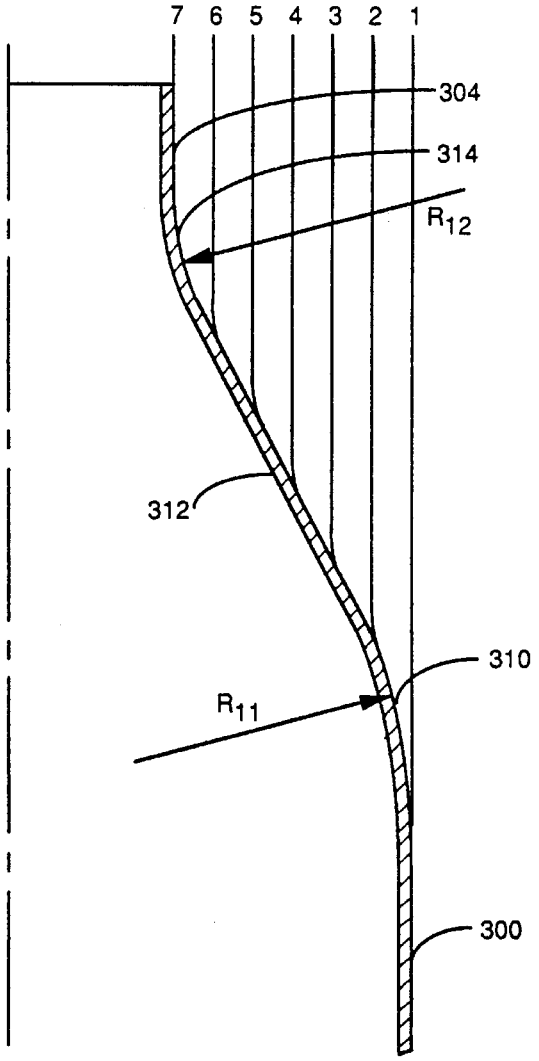
FIG. 21 is a schematic illustration of a sequence of forming the profile of FIG. 20.

It is preferred that the profile of FIG. 20 be made by progressive forming as described in connection with the first two embodiments. In general, it will be preferred to employ about six to eight stages of progressive forming. FIG. 21 illustrates a seven stage forming sequence.

Figure 22:
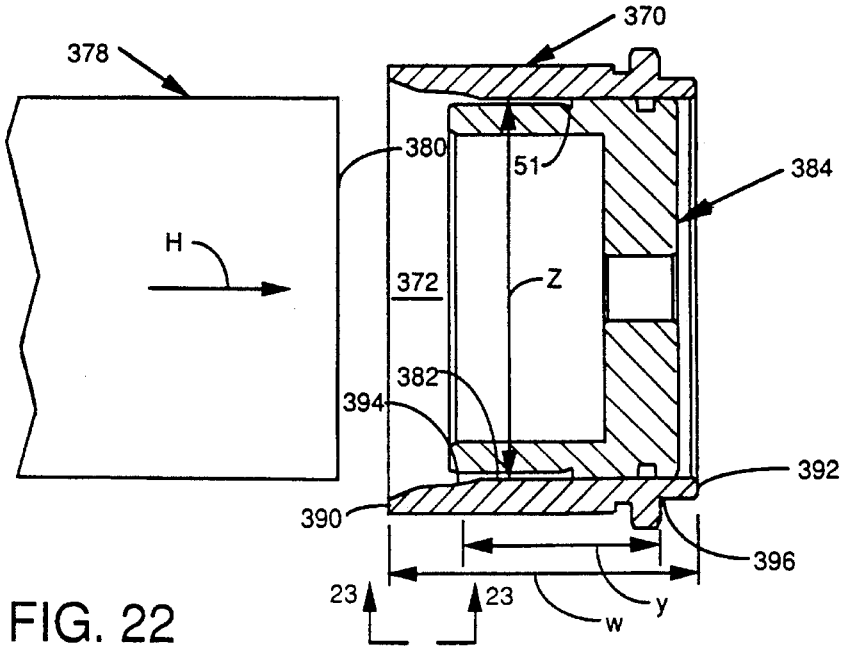
FIG. 22 is a cross-sectional illustration of a form of die employable in the first reduction stage employed in forming profile of FIGS. 20 and 21.
Figure 23:
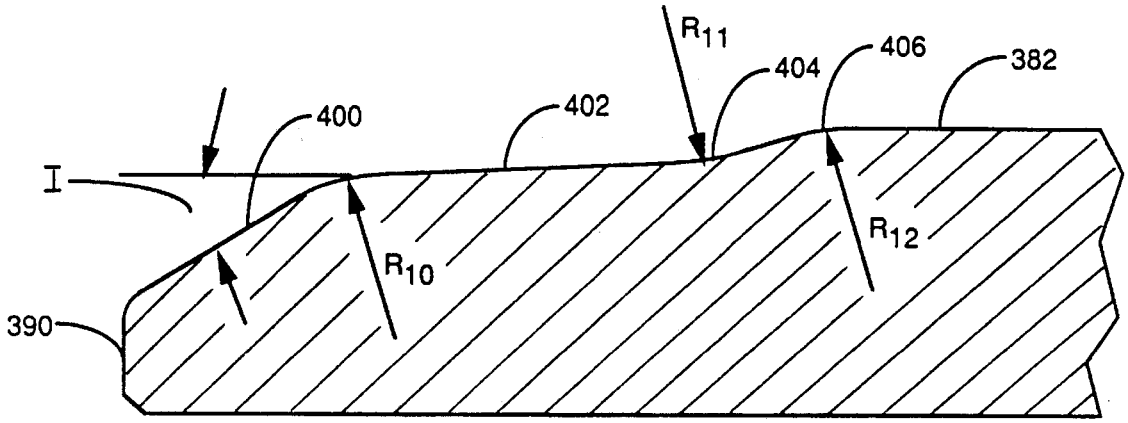
FIG. 23 is a fragmentary cross-sectional illustration of a portion of the die of FIG. 22 taken through 23—23 thereof.

Referring now to FIGS. 22 and 23, a form of tooling suitable for use in manufacturing a profile of the general type of FIG. 20 will be considered. The die 370 has a die cavity 372 within which container 378 which moves in the direction of arrow H will be received. The container's leading edge 380 will enter the die cavity 372, be reformed under the influence die interior surface 394 and will be removed by stepped knock-out member 384. The die has an annular outer surface 390, a pilot surface 400 disposed at an angle I in the form shown in FIGS. 22, 23 will be 30 degrees, a curved transition surface 402 which is connected by a straight surface to curved section 404 of radius $R_{11}$ which, in turn, merges into curved surface 406 which has a radius $R_{12}$. The generally cylindrical interior die surface 382 merges with surface 406. The interior diameter Z of the die in the region 382 is 2.55 inch. The distance Y between surface 394 and 396 is 1.375 inch and the distance W between surface 390 and shoulder 392 is 2.035 inch.

Figure 24:
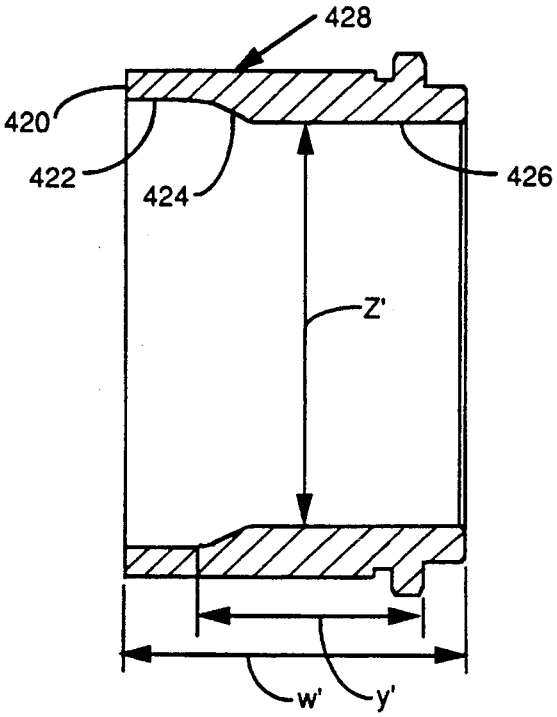
FIG. 24 is a cross-sectional illustration of a die usable in the second reduction stage employed in forming the profile of FIGS. 20 and 21.

FIG. 24 shows the die employable for the second stage of forming. This die 428 has an inner surface 426 of diameter Z' 2.503 inch, a front surface 42, a sloped transition surface 422 and a connecting surface 424 which connects section 422 with section 426. Dimension Y' is 1.405 inch and dimension W' is 2.253 inch.

Successive stages of operation may be performed with dies of generally same configuration as FIG. 24, but with dimensional changes. For example, the third reduction may have an interior diameter Z' of 2.4560 inch, a dimension Y' 1.405 inch, and W' 2.253 inch. The fourth reduction may have an internal diameter Z' 2.4100 inch, a dimension Y' 1.405 inch, and W' 2.253 inch. The fifth reduction may have an internal diameter Z' of 2.3640 with dimension Y' 1.405 inch and W' 2.253 inch. The sixth reduction may have a diameter Z' 2.3180 inch, dimension Y' 1.405 inch, and dimension W' 2.253 inch For the seventh reduction, the Y' and W' dimensions may remain the same with Z' being respectively 2.272 inch.

While for purposes of convenience of disclosure herein, the diameter D of the body 2 has been disclosed as being uniform, in practice the upper portion of this cylindrical body which underlies the necked-in portion may have a slight inward taper on the order of about ½ of a degree. For purposes of the present disclosure such minor departures shall be regarded as being "cylindrical."

Also, while certain preferred approaches employing seven or eight forming stages have been disclosed, it will be appreciated that depending upon certain variables such as metal thickness, severity of reduction, contour of the necked-in area, height of the transition area, effective forming may be accomplished with a different number of reforming stages.

It will be appreciated, therefore, that the multi-stage forming process of the present invention effectively creates the desired neck contour, while limiting each forming stage to predetermined changes in radii and axial extent and resisting undesired wrinkling and maintaining a desired strength. All of this is accomplished while employing uniquely configurated dies which are otherwise adapted to be used in conventional container necking equipment.

It will be appreciated that while primary emphasis has been placed herein, on drawn and ironed aluminum beverage containers, the invention is not so limited.

While for convenience of disclosure the first two embodiments illustrate respectively alternating convex and concave curved necked-in portions having two or four curves, the invention is not so limited, for example, a profile with three or five or more alternating convex-concave sections merging into each other may be provided.

Whereas particular embodiments have been described herein for purposes of illustration, it will be evident to those skilled in the art, that numerous variations of the details may be made without departing from the invention as defined in the offended claims.

I claim:

1. A method of necking an end portion of a metal container comprising effecting a generally radially inward deformation of an axial portion of said container adjacent to an open end of said container to establish a generally cylindrical reduced diameter portion adjacent to said open end of said container and an outwardly generally convex curved transition portion disposed between said reduced diameter portion and the remainder of said container, and sequentially by additional generally radially inward deformation steps axially enlarging said transition portion and reforming at least a part of said generally cylindrical portion into a generally outwardly concave curved configuration which terminates immediately adjacent to said generally convexly outwardly curved portion, creating said outwardly concave curved portion such that it merges into said convexly outwardly curved portion, and creating said generally outwardly convex curved portion and said adjacent generally outwardly concave portion to meet at the point of tangency of each said curved portion.

2. The method of claim 1 including employing said method on a drawn and ironed container.

3. The method of claim 1 including effecting said sequential radial reduction of said necked portion in generally equal amounts with each successive reduction.

4. The method of claim 1 including effecting said necking of said container while resisting undesired wrinkling within said necked-in portion.

5. The method of claim 4 including after completion of said necking establishing a generally radially outwardly projecting flange at the end of said container.

6. The method of claim 1 including creating said necked portion in said generally convexly curved transition portion of a first substantially uniform radius, and said generally outwardly concave portion of a second substantially uniform radius.

7. The method of claim 6 including each said deformation step being effected by a necking die which is brought into the forming contact with said container by establishing relative axial movement between said container and said necking die in order to permit engagement between the exterior surface of the container and the interior surface of said die.

8. The method of claim 7 including employing a plurality of additional dies to sequentially axially enlarge said transition portion and reform at least a portion of said generally cylindrical portion into a generally outwardly concave configuration which merges into said transition portion.

9. The method of claim 7 including creating the radius of said convex portion larger than the radius of said concave portion.

10. The method of claim 9 including employing at least eight said deformation steps in effecting said necking.

11. A method of necking an end portion of a metal container comprising progressively effecting a generally radially inward deformation of an axial portion of said container disposed between an open end of said container and a portion maintained at its initial diameter to establish a necked-in portion, subsequently reforming said necked-in portion to establish at least one outwardly convex portion underlying at least one outwardly concave portion, establishing a second outwardly convex portion overlying said outwardly concave portion, establishing a second outwardly concave portion overlying said second outwardly convex portion, establishing said concave portions and said convex portions alternating with each other and merging into adjacent curved portions, and the radius of said second outwardly concave portion being smaller than the radius of any of the other said outwardly concave and outwardly convex portions.

12. The method of claim 11 including creating two said concave portions and two said convex portions.

13. The method of claim 12 including establishing the lowest said portion as an outwardly convex portion having a first radius, establishing said next overlying portion as an outwardly concave portion having a second radius, establishing said next overlying portion as an outwardly convex portion having a third radius, and establishing said next overlying portion as an outwardly concave portion having a fourth radius.

14. A method of necking an end portion of a metal container comprising progressively effecting a generally radially inward deformation of an axial portion of said container disposed between an open end of said container and a portion maintained at its initial diameter to establish a necked-in portion, subsequently reforming said necked-in portion to establish at least one outwardly convex portion underlying at least one outwardly concave portion, establishing a second outwardly convex portion overlying said outwardly concave portion, establishing a second outwardly concave portion overlying said second outwardly convex portion, establishing said concave portions and said convex portions alternating with each other and merging into adjacent curved portions, creating two said concave portions and two said convex portions, establishing the lowest said portion as an outwardly convex portion having a first radius, establishing said next overlying portion as an outwardly concave portion having a second radius, establishing said next overlying portion as an outwardly convex portion having a third radius, establishing said next overlying portion as an outwardly concave portion having a fourth radius, and said second radius being larger than any of said first radius, third radius and fourth radius.

15. The method of claim 14 including creating said third radius greater than said fourth radius.

16. The method of claim 15 including employing said method on a drawn and ironed aluminum can.

17. The method of claim 14 including creating said fourth radius smaller than any of said first radius, second radius and said third radius.

* * * * *